US006401496B1

(12) United States Patent
Roell

(10) Patent No.: US 6,401,496 B1
(45) Date of Patent: Jun. 11, 2002

(54) METHOD FOR PRODUCING KNITTED FABRICS WITH INTEGRATED FASTENERS

(75) Inventor: Friedrich Roell, Biberach (DE)

(73) Assignees: Stefan Achter, Moenchengladbach; Viktor Nikolaus Achter, Cologne, both of (DE)

( * ) Notice: Subject to any disclaimer, the term of this patent is extended or adjusted under 35 U.S.C. 154(b) by 0 days.

(21) Appl. No.: 09/807,193

(22) PCT Filed: Sep. 17, 1999

(86) PCT No.: PCT/DE99/03050

§ 371 (c)(1),
(2), (4) Date: Jun. 29, 2001

(87) PCT Pub. No.: WO00/22212

PCT Pub. Date: Apr. 20, 2000

(30) Foreign Application Priority Data

Oct. 9, 1998 (DE) ..... 198 47 333

(51) Int. Cl.[7] ..... D04B 1/22
(52) U.S. Cl. ..... 66/170; 66/202
(58) Field of Search ..... 66/170, 177, 198, 66/60 R, 64, 183, 184, 174, 128 R, 202; 297/218.4, 218.5, 226

(56) References Cited

U.S. PATENT DOCUMENTS 5,887,452 A * 3/1999 Smith et al. ..... 66/170
5,890,381 A * 4/1999 Leeke et al. ..... 66/170
5,992,185 A * 11/1999 Leeke et al. ..... 66/170
6,151,926 A * 11/2000 Leeke et al. ..... 66/170

FOREIGN PATENT DOCUMENTS

| | | |
|---|---|---|
| DE | 42 33 827 | 4/1994 |
| DE | 196 36 208 | 3/1998 |
| EP | 0 361 855 | 4/1990 |
| EP | 0 734 670 | 10/1996 |
| GB | 1 465 361 | 2/1977 |
| WO | 93/08985 | 5/1993 |

OTHER PUBLICATIONS

Patent Abstracts of Japan, vol. 15, No. 243, Jun. 21, 1991 & JP 03 077504 A (Okamura Corp), Apr. 1991.

* cited by examiner

*Primary Examiner*—Danny Worrell
(74) *Attorney, Agent, or Firm*—Smith-Hill and Bedell

(57) ABSTRACT

The present invention relates to the process for producing knitted fabrics, in particular seat covers having integrated fasteners. The object of the invention is to improve upon a process of this type so that stable fasteners can be quickly incorporated into a knitted fabric without the need for a great deal of additional work. To accomplish this, at least one connecting piece made of a thermoplastic material is integrated into the knitted fabric by knitting it into said knitted fabric, and it is then subjected to a thermal treatment in order to form a fastener from the connecting piece.

31 Claims, 1 Drawing Sheet

Fig. 1
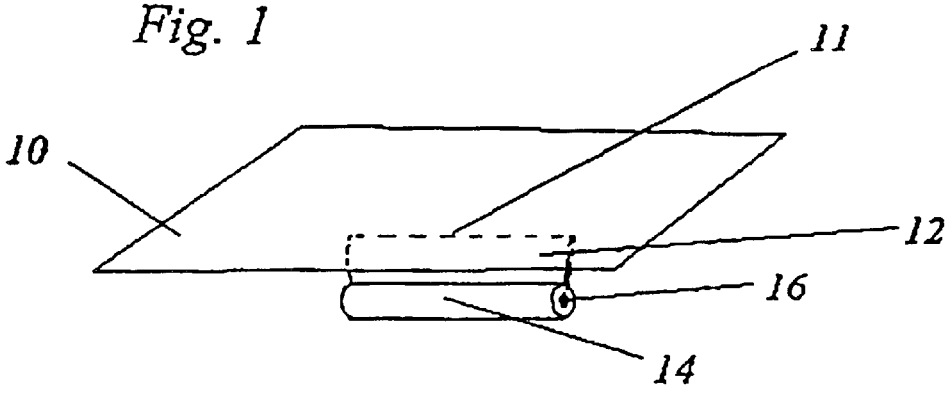
Fig. 2
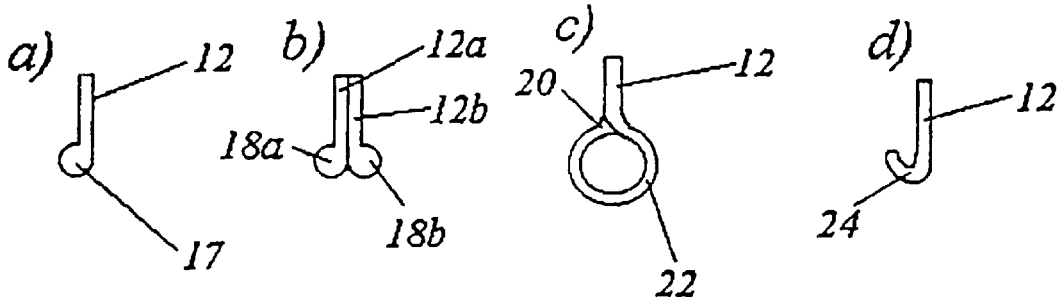
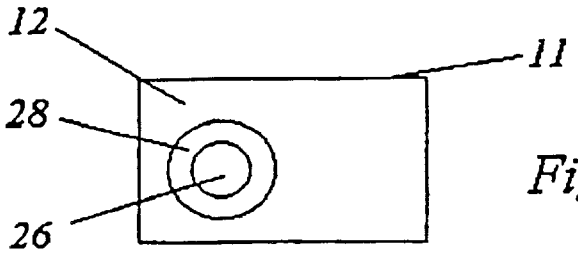
Fig. 3

METHOD FOR PRODUCING KNITTED FABRICS WITH INTEGRATED FASTENERS

BACKGROUND OF THE INVENTION

The invention relates to a process for producing knitted fabrics, in particular seat covers, having integrated fasteners.

In the past, fasteners, such as those in the form of tubes or eyes, had to be sewn onto a preassembled seat cover in a separate sewing operation. Since the seat covers always had to be assembled, in other words, the individual pieces of the seat cover had to be sewn together, sewing the fasteners onto the underside of the seat cover in an additional step constituted a relatively insignificant amount of additional work.

Today, the technology for manufacturing automotive seat covers on flat-bed knitting machines is significantly more advanced, so that it is now possible to knit a quasi-three-dimensional seat cover without ever having to sew one part onto another. This means that conventional sewing—the assembly process—is eliminated altogether. Sewing on fasteners now proves to be an extremely time-consuming additional step that negates part of the time saved with the new knitting technology.

EP 361 855 A1 discloses a process in which tubular fasteners are sewn on in a single piece during manufacturing, in other words, when the seat cover is being knitted. The advantage of this approach is that the additional step of sewing the fasteners on at the desired locations is eliminated. However, this process greatly increases machine operating times, and the tubular fasteners, which are present in the form of tubular knitted pieces, cannot be produced in any desired length or any desired strength. Another disadvantage is that the locations at which the fasteners are knitted on are generally visible on the visible side of the seat cover.

The object of the present intention is therefore to create a process that permits seat covers having integrated fasteners to be manufactured quickly, and in which the fasteners exhibit a high degree of stability and are less visible from the visible side of the knitted fabric than is the case in prior-art processes.

SUMMARY OF THE INVENTION

In the invention, connecting pieces, loops, or tabs are integrated in the knitted fabric at the desired fastening locations while the knitted fabric is being produced. Said connecting pieces, loops, or tabs can either be knitted at the same time as the knitted fabric, or they can be knitted in as a premanufactured part when the knitted fabric is being manufactured. The connecting pieces, loops, or tabs are at least partially manufactured from a thermoplastic material, or a physically or chemically reactive material, in particular thread, whose shape can be altered by means of thermal, physical, or chemical treatment in order to form a fastener. A volume change, such as an increase in thickness, and/or an increase in the hardness of the area being treated can accompany this process. With the treatment, in particular the thermal treatment, the connecting piece or tabs can be formed using a separate premanufactured material that is also thermoplastic or physically or chemically reactive and that is connected to the knitted piece during the course of manufacturing. This element may preferably be supplied to the knitting area from a roll having a special feed system, such as a controllable feed system, via the thread guide rails on the flat-bed knitting machine and the needle gap. In the knitting area it is then knitted together with the knitted piece at the fastening points.

In addition, other elements such as metal strips, wires or eyes made of metal or plastic can be combined with the treated area. These elements can form the actual fastening points in the fasteners.

The connecting piece can be rolled up and heated—for example in a thermal process—in such a way that a fastening welt is produced. This welt could then be pulled into a rail on a support for an automotive seat. During the thermal process, one or more eyes can be formed in the connecting piece and said eyes could then optionally be reinforced with metal rings, if desirable due to the presence of higher fastening forces. Rods or cords can subsequently be inserted into the eyes formed in this manner, or into loops formed after the treatment process, to produce the fasteners used to fasten the knitted fabric to the frame.

The thermoplastic material of the thread used to knit the connecting piece is preferably a material that is harder and preferably non-elastic after the thermal treatment process and is able to withstand higher forces. The connecting piece/loop/tab can also be reinforced in particular using materials from the family of fiber composites. Since materials and composites having properties that differ from those of the remaining knitted fabric can be used for the connecting pieces, the first rows of the connecting piece, for example, can be knitted using a thicker thread and can therefore form a bead that is already thicker before the thermal/physical/chemical treatment process is carried out.

The process of the invention can even be used to produce tubes as fasteners by folding over the connecting piece one time and then fusing it to another area of the connecting piece at the outer edge. During the fusion process, the entire connecting piece material can be fused together in such a way that the entire tube body is much more rigid than the originally knitted thread material. In this way, rigid and extremely stable fasteners that have virtually no elasticity can be produced, similar to those disclosed in the prior-art tubular knitted fabrics in the aforesaid European publication.

Integrally knitting a connecting piece onto a knitted fabric, such as seat cover, is an essentially known art. It can be accomplished by activating or deactivating certain areas of the needle bed, or by knitting the connecting piece on a second needle bed and transferring it onto the main knitting bed at the desired location, so that the said connecting piece becomes an integral part of the knitted fabric. Of course, the connecting piece does not need to be knitted from the same thread as the rest of the knitted fabric. Since this connecting piece has to be able to serve as a fastener and withstand relatively high forces following the thermal treatment, it can be knitted, for example, from a stronger thread. By properly selecting the thread material, it is possible to take into account the desired amount of deformation following the thermal posttreatment. One can therefore use a thread material adapted to a given application, regardless of the thread material used in the remainder of the knitted piece. The part of the connecting piece or tab that will not be treated thermally, physically, or chemically can also be knitted using a thread having a higher elasticity and/or a more elastic bond, thus permitting the fastener to be attached to a frame or to another fastener with an elastic preload.

Moreover, it is not necessary that the connecting piece be knitted at the same time as the rest of the knitted piece, and it may be thermally treated after it is joined to the knitted fabric. Thus, the connecting pieces can be knitted separately from the remaining knitted piece and be thermally treated ahead of time in order to form a fastener. In this case, the integration of the premanufactured fastener is accomplished merely by transferring the loops from the separate needle bed on which the loops of the connecting piece are engaged onto the needle bed on which at least one row of the knitted piece has been knitted.

In this regard, it must once again be noted that it is possible for the process of the invention to produce the entire knitted fabric, including the fasteners, on a flat-bed knitting machine or on a circular knitting machine. The thermal treatment to produce the fasteners can take place either before or after the connecting piece is connected to the knitted piece.

The process of the invention can be used on flat-bed knitting machines as well as on circular knitting machines. When stripers or sinkers are used with a plurality of needle beds, the connecting pieces as well as the knitted piece can easily be knitted in an alternating fashion or simultaneously.

The thermal treatment of the loops allows all manner of fastener shapes to be produced-for example, hooks facing in one direction, hooks facing in two directions, loops, welts, braiding, and many other configurations. In order to reinforce the fastening area, various materials made of metal, plastic, natural or inorganic fiber materials can be used. Following the thermal treatment, these materials are connected in an interlocking manner to the fiber materials of the connecting piece.

The material is preferably joined to a fastener or fastening profile during the thermal, physical, or chemical treatment. This fastener can possess the preformed fastening areas or fastening profiles in order to fasten the knitted fabric to the frame. During the treatment, all that needs to be done is to connect the connecting piece to this fastening profile. This is particularly easy to accomplish if the fastener or fastening profile is made of the same material as the thermoplastic or physically or chemically reactive material of the connecting piece or tab that is to be treated.

The invention is not just limited to fastening seat covers on seat cover frames. It can also be used to fasten pieces of trim (design) fabric, insulating parts, filter textiles, medical textiles, etc.

BRIEF DESCRIPTION OF THE DRAWINGS

The invention will now be described below, by way of example, with reference to the accompanying drawings, which show:

FIG. 1 a perspective view of a section of a knitted piece having an integrated knitted-on connecting piece whose exposed edge encloses a piece of wire;

FIGS. 2*a*–2*d* four different ways to thermally treat the free edge of the connecting piece to create a fastener; and FIG. 3 a top view onto a connecting piece incorporating an eye.

DETAILED DESCRIPTION

FIG. 1 shows a three-dimensional view of a section of a knitted piece 10 onto which a connecting piece 12 is knitted at edge 11. A knitted fabric of this type can, for example, be the knitted fabric for an automotive seat cover that has to be secured by means of fasteners onto an automotive seat frame on the side opposite the seating surface. The free edge 14 of the connecting piece 12 is rolled over and, after a piece of wire 16 is inserted into the resulting cavity, it is fused together with the connecting piece so that the piece of wire is securely held in the connecting piece. Thermal treatment also increases the hardness of. the material, in part due to the breakdown of the loop structure during the fusing process, so that an extremely stable fastener is obtained.

FIG. 2 shows different ways of forming fasteners. All the figures show end views of the connecting piece 12. In FIG. 2*a* the free edge 14 of the connecting piece is folded over to one side and then heated so that a bead is formed on this side.

FIG. 2*b* shows a two-ply connecting piece, 12*a* and 12*b*, whose free edges, 18*a* and 18*b*, have been folded over away from each other and heated so that a bead-shaped thick area (welt) is produced on both sides of the connecting piece. A fastener of this type can easily be engaged in a channel, which serves as the mating fastener.

FIG. 2*c* shows one way in which the free end 20 of the connecting piece is folded over onto a center section of connecting piece to form a loop 22 and the free end is connected to the section of the connecting piece that it touches by means of a thermal fusing process. In this way, the resulting fastener is a cylinder, through which a retaining rod can be passed, for example. Cylinder section 22 can also be hardened by means of thermal treatment.

FIG. 2*d* shows a connecting piece 12 on which the free end 24 has been bent over to one side and then thermally hardened to produce a hook-like fastener, which can engage in a mating hook, channel or similar element.

Finally, FIG. 3 shows a connecting piece 10 in which one area 26 has been perforated and thermally widened, so that a hard plastic bead 28 has formed around the perforation. In this way, an eye is obtained as the fastener. A tensioning hook can then be passed through this eye. In addition to the plastic bead 28, a metal reinforcing ring can also be inserted to make the eye more rigid.

What is claimed is:

1. A process of producing a fabric piece having a fastener integrated therein, comprising:

knitting the fabric piece, during the knitting of the fabric piece, incorporating a knitted connecting piece into the knitted fabric piece, the connecting piece being made at least partially of a material that can be modified to substantially rigid form by a predetermined treatment, and subjecting at least a part of the knitted connecting piece to said predetermined treatment in order to form a substantially rigid object at the location of treatment, said substantially rigid object being attached to said fabric piece.

2. The process of claim 1, wherein said predetermined treatment is selected from the group consisting of thermal treatment, physical treatment and chemical treatment.

3. The process of claim 1, wherein said predetermined treatment includes thermal treatment and the method comprises heating the knitted connecting piece in a compression mold.

4. The process of claim 1, wherein said predetermined treatment includes thermal treatment and the method comprises folding or rolling at least one section of the knitted connecting piece before said thermal treatment, and forming said one section into a thicker section of a fastener in said thermal treatment.

5. The process of claim 1, wherein said predetermined treatment includes thermal treatment and the method comprises folding the connecting piece prior to the thermal treatment so that a free edge of the connecting piece contacts another part of the connecting piece, and applying the thermal treatment to the location at which the free longitudinal edge of the connecting piece contacts the other part of the connecting piece to join the free edge of the connecting piece to said other part of the connecting piece.

6. The process of claim 1, wherein said predetermined treatment includes thermal treatment and the method comprises connecting a reinforcing element to the connecting piece in the thermal treatment.

7. The process of claim 1, wherein said predetermined treatment includes thermal treatment and the method comprises enclosing a reinforcing element by a portion of the connecting piece in an interlocking manner.

8. The process of claim 1, comprising providing the substantially rigid object with a reinforcement.

9. The process of claim 8, wherein said predetermined treatment includes thermal treatment and the method comprises forming the connecting piece in the thermal treatment in such a way that an eye is produced, and reinforcing said eye with a metal or plastic ring.

10. The process of claim 4, comprising knitting the connecting piece in two plies, rolling both plies over away from one another to form respective rolls, and thermally rigidifying the rolls to form respective welts facing away from one another.

11. The process of claim 1, comprising knitting the connecting piece using thread different from that of the knitted fabric piece.

12. The process of claim 1, comprising connecting the material to a fastener or fastening profile during said predetermined treatment.

13. The process of claim 12, wherein the fastener or fastening profile is made of said material that can be modified to substantially rigid form by said predetermined treatment.

14. A process of producing a fabric piece having a fastener integrated therein, comprising:

knitting the fabric piece on a first needle bed, knitting a separate connecting piece on a second needle bed, the connecting piece being made at least partially of a material that can be modified to substantially rigid form by a predetermined treatment, subjecting at least a part of the knitted connecting piece to said predetermined treatment in order to form a substantially rigid object at the location of treatment, transferring the knitted connection piece from the second needle bed to the first needle bed and thereby integrating the knitted connection piece into the knitted fabric piece.

15. The process of claim 14, wherein said predetermined treatment is selected from the group consisting of thermal treatment, physical treatment and chemical treatment.

16. The process of claim 14, wherein said predetermined treatment includes thermal treatment and the method comprises heating the knitted connecting piece in a compression mold.

17. The process of claim 14, wherein said predetermined treatment includes thermal treatment and the method comprises folding or rolling at least one section of the knitted connecting piece before said thermal treatment, and forming said one section into a thicker section of a fastener in said thermal treatment.

18. The process of claim 14, wherein said predetermined treatment includes thermal treatment and the method comprises folding the connecting piece prior to the thermal treatment so that a free edge of the connecting piece contacts another part of the connecting piece, and applying the thermal treatment to the location at which the free longitudinal edge of the connecting piece contacts the other part of the connecting piece to join the free edge of the connecting piece to said other part of the connecting piece.

19. The process of claim 14, wherein said predetermined treatment includes thermal treatment and the method comprises connecting a reinforcing element to the connecting piece in the thermal treatment.

20. The process of claim 14, wherein said predetermined treatment includes thermal treatment and the method comprises enclosing a reinforcing element by a portion of the connecting piece in an interlocking manner.

21. The process of claim 14, comprising providing the substantially rigid object with a reinforcement.

22. The process of claim 21, wherein said predetermined treatment includes thermal treatment and the method comprises forming the connecting piece in the thermal treatment in such a way that an eye is produced, and reinforcing said eye with a metal or plastic ring.

23. The process of claim 17, comprising knitting the connecting piece in two plies, rolling both plies over away from one another to form respective rolls, and thermally rigidifying the rolls to form respective welts facing away from one another.

24. The process of claim 14, comprising knitting the connecting piece using thread different from that of the knitted fabric piece.

25. The process of claim 14, comprising connecting the material to a fastener or fastening profile during said predetermined treatment.

26. The process of claim 25, wherein the fastener or fastening profile is made of said material that can be modified to substantially rigid form by said predetermined treatment.

27. An article of manufacture comprising a knitted fabric piece and at least one knitted-on connecting piece integrated with the knitted fabric piece, wherein the connecting piece is made at least partially of a material that can be fused to substantially rigid form by thermal treatment and includes a substantially rigid fastener formed by fusing together the loop structure of the connecting piece.

28. The article of claim 27, wherein the fastener includes a shape-exhibiting part which is at least partially interlocked or engaged by the fused loop structure.

29. The article of claim 28, wherein the shape-exhibiting part is a metal wire or a metal eye.

30. The article of claim 27, wherein the connecting piece is made of a different thread material than the rest of the knitted fabric.

31. The article of claim 27, wherein the article is a seat cover.

* * * * *